United States Patent [19]

Jaw

[11] Patent Number: 5,041,037

[45] Date of Patent: Aug. 20, 1991

[54] OAR

[76] Inventor: Horng C. Jaw, 6 Fl., No. 21, Alley 29, Lane 372, Sec. 5, Chung Hsiao E. Rd., Taipei, Taiwan, Taiwan

[21] Appl. No.: 601,991

[22] Filed: Oct. 23, 1990

[51] Int. Cl.[5] ..... B63H 16/04

[52] U.S. Cl. ..... 440/102; 416/74; 416/70 R; 440/101

[58] Field of Search ..... 440/101-109; 416/70 R, 69, 72-74

[56] References Cited

U.S. PATENT DOCUMENTS

| | | | |
|---|---|---|---|
| 1,066,662 | 7/1913 | Schmidt, Jr. | 416/74 |
| 1,555,097 | 9/1925 | Beebe | 416/74 |
| 3,122,122 | 2/1964 | Jenkins | 440/19 |
| 3,135,977 | 6/1964 | Vidal | 416/74 |
| 3,377,977 | 4/1968 | Malm | 440/13 |

*Primary Examiner*—Ed Swinehart

*Attorney, Agent, or Firm*—Merchant, Gould, Smith, Edell, Welter & Schmidt

[57] ABSTRACT

An oar includes a blade portion, a loom including a grip, and a connecting member for connecting the blade portion and the loom together. The blade portion includes a frame and two blades. The frame includes two parallel vertical plates, a front plate, a top plate, a bottom plate and an open rear side defined by the vertical plates, the top plate and the bottom plate. A rectangular slot is formed between each blade and the front plate. A protrusion is formed on a top edge and a bottom edge of each blade. The blades are pivotally restrained in the rectangular slots with the protrusions engaging with corresponding holes formed on the top plate and bottom plate of the frame.

4 Claims, 5 Drawing Sheets

OAR

BACKGROUND OF THE INVENTION

The present invention relates to an oar, and more particularly, to an oar having two blades that swivel during its back and forth motion below the water level so as to efficiently transfer the force applied by the user to propel a boat.

Conventionally, when rowing a boat, the oars lie on the oarlocks provided on the gunwale of the boat for the operator to grip the oars and operate them. A conventional oar generally has only one blade. During operation, the blade of the oar rises above the water level, passes through the air, and then re-enters the water for the next stroke to propel the boat. However, the operator is usually splashed by water when the blade of the oar breaks the water surface. In addition, force applied by the operator is often inefficiently utilized wastes due to an improper angle of the blade in the water during the stroke. Furthermore, conventional oars can only be provided on a gunwale with considerable height, which results a limitation in the usage of the oars.

The present invention provides an improved oar having two swiveling blades always retained under the water level and act like a duck's webbed feet, to mitigate and/or obviate the afore-mentioned problems.

SUMMARY OF THE INVENTION

It is an object of the present invention to provide an oar having two blades which does not leave the water during use.

It is another object of the present invention to provide an oar having two blades that swivel below the water level to efficiently transfer the force applied by the user to propel a boat.

It is still another object of the present invention to provide an oar which can be operated by child due to its simple operation.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 6:
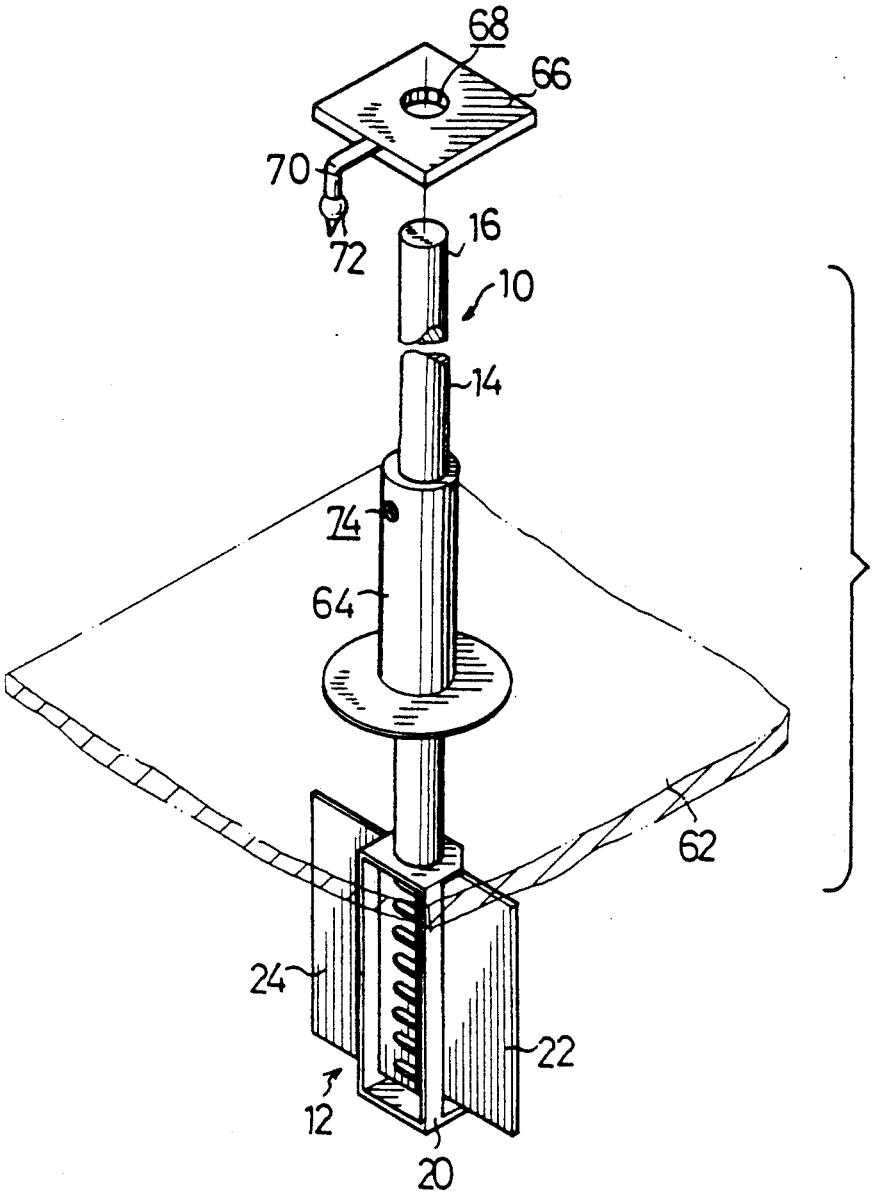
FIG. 6 is schematic view showing the installation of the oar on a bottom board of an air boat made of PVC material.

Referring to FIGS. 1 through 4 and FIG. 6, in which a blade portion 12 of an improved oar 10 according to the present invention is shown. As shown in FIG. 6, the oar 10 includes a blade portion 12, a loom 14 including a grip 16, and a connecting means 18 for connecting the blade portion 12 to the loom 14. The connecting means 18 has a threaded outer periphery to engage with a lower end, with inner threads, of the loom 14 to form a complete oar. The connecting means 18 is hollow and integral with the blade portion 12.

Figure 3:
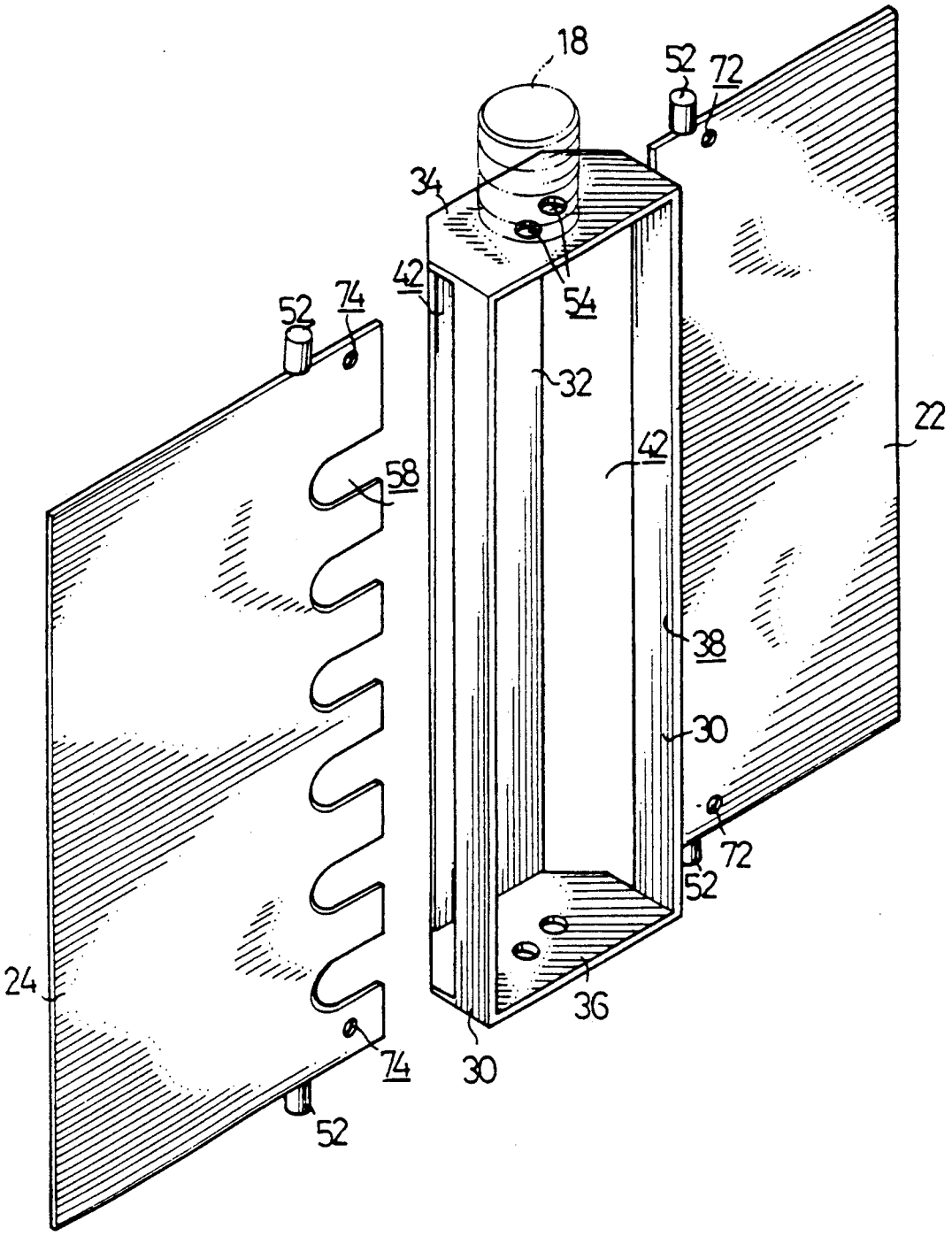
FIG. 3 is a perspective exploded view of the blade portion of the oar according to the present invention.

The blade portion 12 includes a frame 20 and two blades 22 and 24. As shown in FIG. 3, the frame 20 includes two parallel vertical plates 30, a front plate 32, a top plate 34, a bottom plate 36, and a rear open side 38 defined by the vertical plates 30, the top plate 34 and the bottom plate 36. A rectangular slot 42 is formed between each blade 22 and 24 and the front plate 32. On a top edge and a bottom edge of both the blades 22 and 24 there is a protrusion 52 formed thereon. The blades 22 and 24 are pivotally restrained in the rectangular slots 42 with the protrusions 52 engage with corresponding holes 54 formed on the top plate 34 and bottom plate 36 of the frame 20.

Figure 5:
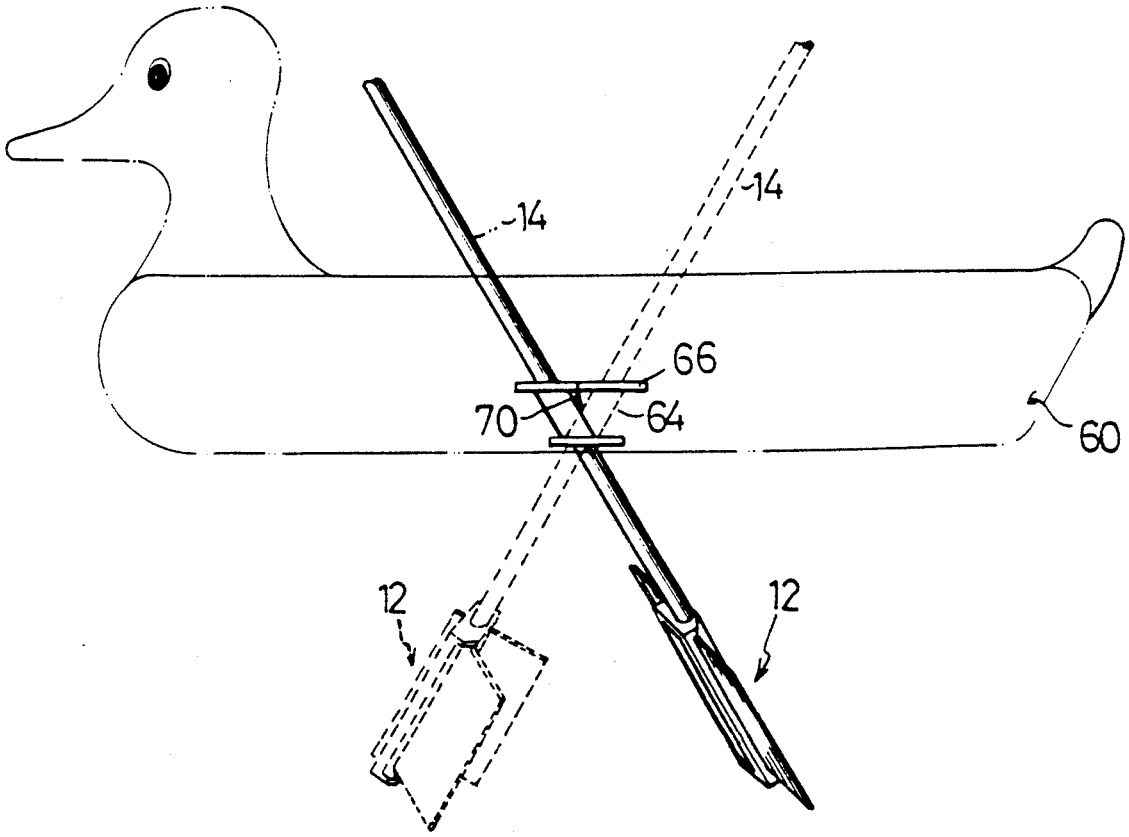
FIG. 5 is a schematic view showing the operation of the oar mounted on an air boat made of PVC material.

FIG. 6 shows the installation of the oar 10 to a bottom board 62 of an air boat 60 made of PVC material (see FIG. 5). The blade portion 12 is disposed under the water level beneath the bottom board 62 with the loom 14 passing upwardly through a retaining means 64 provided on the bottom board 62. A positioning means 66 is provided to orient the oar 10 in a fixed direction. The positioning means 66 has a hole 68 allowing the loom 14 to pass therethrough. A positioning strip 70 with a positioning head 72 extends from the positioning means 66. After the loom 14 is installed in the retaining means 64, the positioning head 72 passes through a hole 74 on the retaining means 64 and a hole (not shown) on the loom 14, thereby positioning the whole oar 10 in a fixed orientation, such that, the front plate 32 of the frame 20 always faces the boat's forwarding direction. The retaining means 64 is made of elastic material, such as soft PVC. material, so that it is flexible and follows the back and forth movement of the oar.

FIG. 5 shows the operation of the present oar 10. When the operator moves the blade portion 12 of the oar 10 from a backwardmost position (as shown by the solid line in FIG. 5) to a forwardmost position (as shown by the phantom line in FIG. 5), due to the water resistance, the blades 22 and 24 swivel to a status shown in FIG. 2 and by the phantom line in FIGS. 4 and 5. Water passes through the rear open side 38 and the slots 42 along both sides of the blades 22 and 24, in which the water flow is indicated by the arrow in FIG. 2. In this manner, the angle between the two blades 22 and 24 is about 40°. A plurality of U-shape slots 58 are formed on an inner side of blade 24, to reduce the flow resistance from the water.

Figure 1:
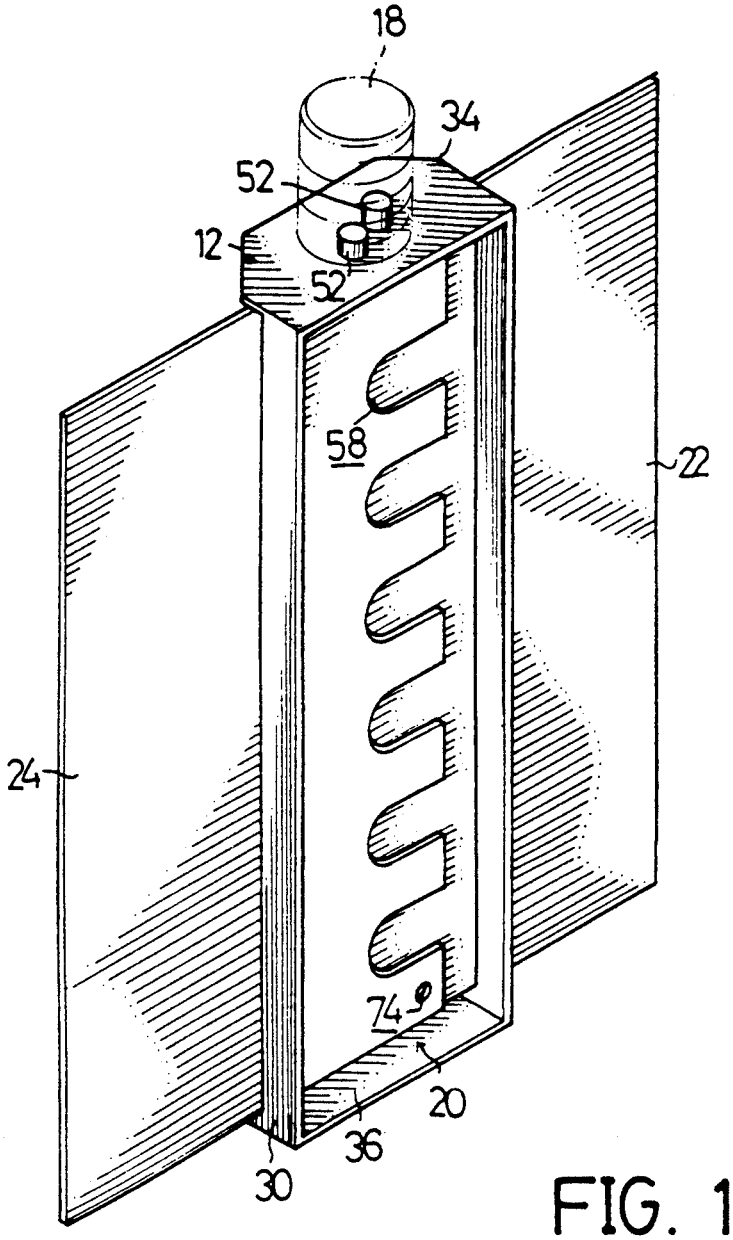
FIG. 1 is a perspective view of a blade portion of an oar according to the present invention, in which the blades are in a first status.
Figure 2:
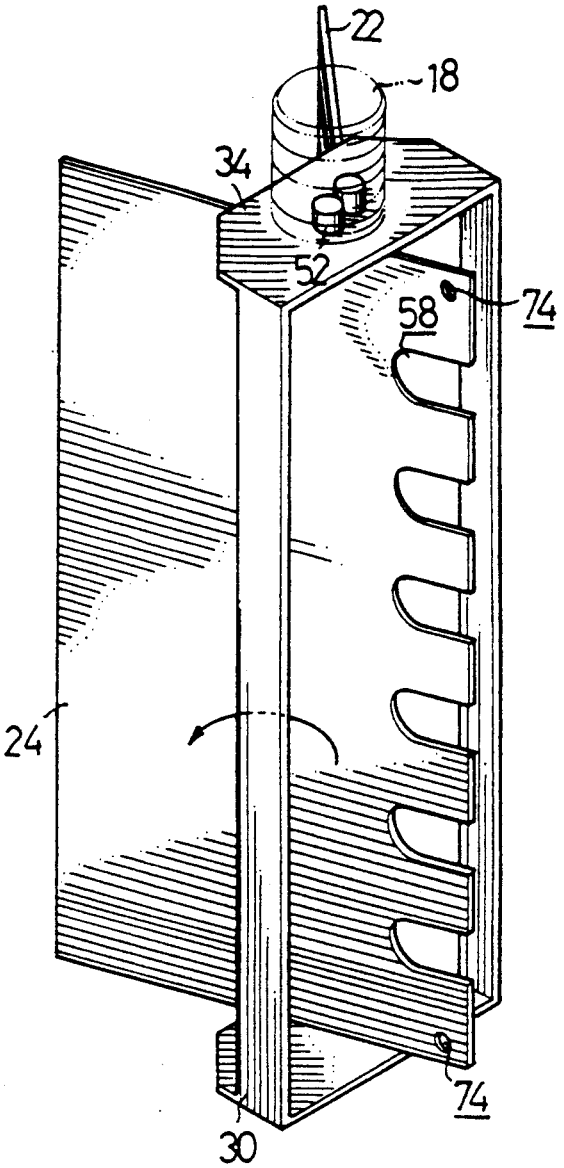
FIG. 2 is a perspective view of the blade portion of the oar according to the present invention, in which the blades are in a second status.
Figure 4:
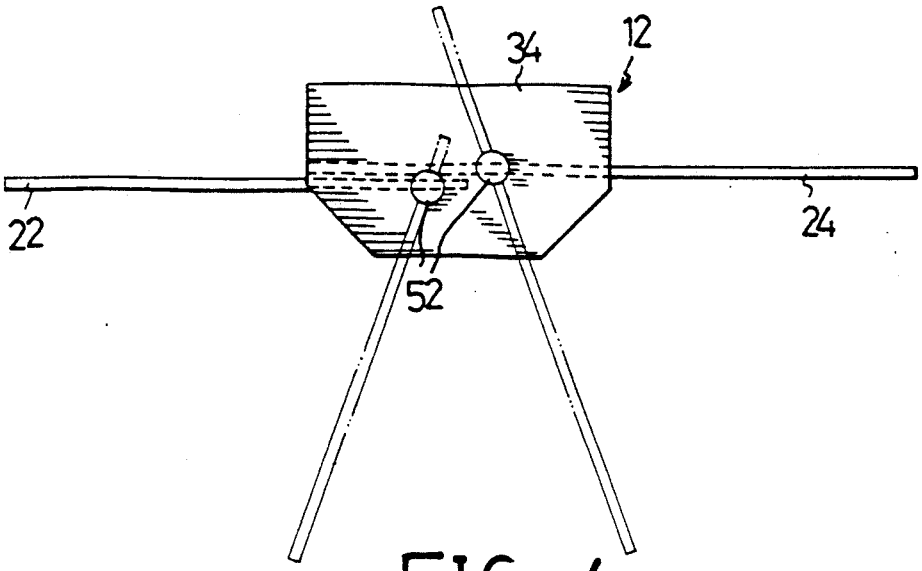
FIG. 4 is a top view of the blade portion of the oar according to the present invention, in which a connecting means is omitted from the blade portion to clearly show the blades.

Still referring to FIG. 5, when the operator moves the oar 10 from the forwardmost position to the backwardmost position, owing to the flow resistance from the water, the blades 22 and 24 immediately swivel to a status shown by the solid line in FIGS. 4 and 5, and in FIG. 1. Incidentally, blade 22 is retained by the plurality of slots 58 of blade 24 when the two blades are in a status shown in FIG. 1. By the provision of the side plates 30 and the plurality of U-shaped slots 58 of blade 24, the two blades 22 and 24 are supported and no further swivel will occur.

It can be seen that the blades 22 and 24 of the oar 10 are always below the water level. In addition, the orientation of the blades 22 and 24 are fixed during operation. Accordingly, the force applied by the operator is effectively transferred to the blades to propel the boat. Furthermore, even a child may operate the present oar due to its simple operation and safe structure. Nevertheless, moving direction of the paddles, together with the boat, depends on the direction of force applied by the operator. This is because the retaining means 64 is flexible in any direction. Accordingly, the boat may turn to the left or right as provided by conventional operation of boat.

As shown in FIG. 3, on each blade 22 and 24, two holes 72 and 74 are respectively formed on opposite sides of the blades 22 and 24. The holes 72 and 74 are arranged so that holes 72 align with holes 74 when the two blades 22 and 24 are in a status shown in FIG. 1. Pins (not shown) may be provided to fix the two blades 22 and 24 together, such that the oar 10 according to the present invention may be used as a conventional oar. Furthermore, the present oar also can be utilized, in cooperation with a retaining ring, on any floating mattresses with no gunwale, which is impossible for a conventional oar.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. An oar comprising:

a blade portion, a loom including a grip, and a connecting means for connecting said blade portion to said loom, said blade portion comprising a frame and two blades, said frame comprising two parallel vertical plates, a front plate, a top plate, a bottom plate and a rear open side defined by said vertical plates, said top plate and said bottom plate, a rectangular slot being formed between each said vertical plate and said front plate, a protrusion being formed on a top edge and a bottom edge of each said blade, said blades being pivotally restrained in said rectangular slots with the protrusions engaging with corresponding holes formed on said top plate and said bottom plate of said frame.

2. An oar according to claim 1, further comprising at least two holes respectively formed on opposite sides of said blades, the holes on one of said two blades aligning with the holes on the other blade when the two blades are parallel to said front plate of said frame; said holes adapted to receive pins for fixing the two blades together.

3. An oar for an air boat comprising:

a blade portion, a loom including a grip, and a connecting means for connecting said blade portion to said loom, said blade portion comprising a frame and two blades, said frame comprising two parallel vertical plates, a front plate, a top plate, a bottom plate and a rear open side defined by said vertical plates, said top plate and said bottom plate, a rectangular slot being formed between each said vertical plate and said front plate, a protrusion being formed on a top edge and a bottom edge of each said blade, said blades being pivotally restrained in said rectangular slots with said protrusions engaging with corresponding holes formed on said top plate and said bottom plate of said frame;

said oar being mounted to a bottom board of the air boat with said blade portion disposed under the water level beneath the bottom board and said loom passing upwardly through a retaining means provided on the bottom board, said retaining means preventing said oar from falling down into the water.

4. An oar according to claim 3, further comprising a positioning means for positioning said blades in a fixed orientation, said positioning means having a hole through which said positioning means is provided on said loom of said oar, a positioning strip with a positioning head extending from said positioning means, said blades being oriented by means of said positioning head passing through a hole ôn said retaining means and a hole on said loom.

* * * * *

UNITED STATES PATENT AND TRADEMARK OFFICE

CERTIFICATE OF CORRECTION

PATENT NO. : 5,041,037

DATED : Aug. 20, 1991

INVENTOR(S) : Horng C. Jaw

It is certified that error appears in the above-identified patent and that said Letters Patent is hereby corrected as shown below:

Column 1, line 21, after "utilized" delete "wastes"; line 24, after "results", insert --in--; line 41, after "by", insert --a--.

Column 2, line 24, "engage" should read --engaging--.

Column 3, line 14, after the word "of", insert --the--.

Signed and Sealed this

First Day of June, 1993

*Attest:*

Michael K. Kirk

MICHAEL K. KIRK

*Attesting Officer*

*Acting Commissioner of Patents and Trademarks*